US009816157B2

(12) United States Patent
Fang et al.

(10) Patent No.: US 9,816,157 B2
(45) Date of Patent: Nov. 14, 2017

(54) POWDER METALLURGY METHODS FOR THE PRODUCTION OF FINE AND ULTRAFINE GRAIN TI AND TI ALLOYS

(71) Applicant: University of Utah Research Foundation, Salt Lake City, UT (US)

(72) Inventors: Zhigang Zak Fang, Salt Lake City, UT (US); Pei Sun, Salt Lake City, UT (US); James Paramore, Salt Lake City, UT (US); Hongtao Wang, Salt Lake City, UT (US); Mark Koopman, Salt Lake City, UT (US); Lu Yang, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 530 days.

(21) Appl. No.: 14/152,787

(22) Filed: Jan. 10, 2014

(65) Prior Publication Data

US 2014/0255240 A1 Sep. 11, 2014

Related U.S. Application Data

(63) Continuation-in-part of application No. 14/062,590, filed on Oct. 24, 2013, now abandoned, which is a (Continued)

(51) Int. Cl.
*C22C 1/04* (2006.01)
*B22F 3/10* (2006.01)

(52) U.S. Cl.
CPC ..... *C22C 1/0458* (2013.01); *B22F 3/101* (2013.01); *B22F 2999/00* (2013.01)

(58) Field of Classification Search
CPC .... B22F 2201/013; B22F 3/101; C22F 1/183; C22C 1/0458

(Continued)

(56) References Cited

U.S. PATENT DOCUMENTS 3,472,705 A 10/1969 Gregory
3,950,166 A 4/1976 Obara et al.

(Continued)

FOREIGN PATENT DOCUMENTS

EA 200901219 A1 4/2011
UA 51917 A 1/2002

(Continued)

OTHER PUBLICATIONS

Bertheville et al.; Powder sintering and shape memory behavior of NiTi compacts synthesized from Ni and TiH2; Materials Science and Engineering: A; Oct. 2004; pp. 143-150; vol. 384, Issues 1 -2; Elsevier BV (Continued)

*Primary Examiner* — Weiping Zhu
(74) *Attorney, Agent, or Firm* — Thorpe North & Western, LLP

(57) ABSTRACT

A process includes sintering hydrogenated titanium or titanium hydride ($TiH_2$) and/or Ti metal in a dynamically controlled hydrogen atmosphere with hydrogen partial pressure greater than 0.01 atmosphere and at elevated temperature, to form a sintered titanium material; equilibrate the sintered material at an equilibration temperature below the sintering temperature and above the phase transformations including eutectoid decomposition temperature for an equilibration time sufficient for the hydrogen within the sample to reach equilibrium and homogenize the sintered titanium material; holding the sintered titanium material at a hold temperature below the temperature of sintering and a hold time sufficient for phase transformations including eutectoid decomposition of the sintered titanium material; and heating the sintered titanium material under vacuum, inert atmosphere, or a combination of both at a hold temperature which is less than that of the sintering temperature, (Continued)

to form titanium metal, or a titanium metal alloy with fine or ultrafine grain sizes; where the dynamically controlled hydrogen atmosphere varies as a function of time and temperature throughout the thermal cycle and includes hydrogen during the sintering and phase transformations including eutectoid decomposition steps.

33 Claims, 4 Drawing Sheets

Related U.S. Application Data continuation-in-part of application No. PCT/US2011/061685, filed on Nov. 21, 2011.

(60) Provisional application No. 61/479,177, filed on Apr. 26, 2011, provisional application No. 61/789,549, filed on Mar. 15, 2013.

(58) Field of Classification Search
USPC ..... 420/417
See application file for complete search history.

(56) References Cited

U.S. PATENT DOCUMENTS

| | | | | |
|---|---|---|---|---|
| 4,219,357 | A | 8/1980 | Yolton et al. | |
| 4,838,935 | A | 6/1989 | Dunlop et al. | |
| 4,923,513 | A * | 5/1990 | Ducheyne | C22F 1/183 148/421 |
| 5,024,813 | A | 6/1991 | Nishiyama | |
| 5,108,517 | A | 4/1992 | Kimura et al. | |
| 5,441,695 | A | 8/1995 | Gladden | |
| 5,447,582 | A | 9/1995 | Eylon et al. | |
| 6,638,336 | B1 | 10/2003 | Drozdenko et al. | |
| 6,852,273 | B2 | 2/2005 | Ivanov et al. | |
| 7,311,873 | B2 | 12/2007 | Moxson et al. | |
| 7,993,577 | B2 | 8/2011 | Duz et al. | |
| 8,007,562 | B2 | 8/2011 | Kasparov et al. | |
| 8,388,727 | B2 | 3/2013 | Klevtsov et al. | |
| 2003/0211001 | A1 | 11/2003 | Ivasishin et al. | |
| 2011/0171116 | A1 | 7/2011 | Klevtsov et al. | |
| 2012/0058002 | A1 | 3/2012 | Ivasishin et al. | |
| 2013/0315773 | A1 | 11/2013 | Moxson et al. | |

FOREIGN PATENT DOCUMENTS

| | | | |
|---|---|---|---|
| UA | 56116 | A | 4/2002 |
| UA | 65654 | C2 | 4/2004 |
| UA | 70366 | C2 | 10/2004 |
| UA | 14168 | U | 5/2006 |
| UA | 92714 | C2 | 5/2010 |
| WO | WO 2013/022531 | | 2/2013 |

OTHER PUBLICATIONS

Carreno-Morelli et al.; Powder Injection moulding of titanium from TiH2 powders; Euro PM2009 Proceedings; May 2009; 6 pages; European Powder Metallurgy Association.

Fang et al.; Hydrogen Sintering of Titanium to Produce High Density Fine Grain Titanium Alloys; Advanced Engineering Materials; Jun. 2012; pp. 383-387; vol. 14, No. 6; Wiley-VCH Verlag GmbH & Co.

Froes; Hydrogen as a temporary alloying element in titanium alloys: themohydrogen processing; International Materials Review; Jun. 2004; pp. 227-244; vol. 49, No. 3 -4; IoM Communications Ltd. and ASM International.

Greenspan et al.; Metal Matrix Composites by Decomposition Sintering of Titanium Hydride; Technical Report; Dec. 1970; 13 pages; Army Materials and Mechanics Research Center, Watertown, Massachusetts.

Greenspan et al.; Titanium powder metallurgy by decomposition sintering of the hydride; in Section IV of Jaffee et al. (eds.) Titanium Science and Technology; Jul. 1973; pp. 365-379; Springer International Publishing AG.

Ivasishin et al.; Cost-effective blended elemental powder metallurgy of titanium alloys for transportation applications; Key Engineering Materials; Jan. 2000; pp. 55-62; vol. 188; Trans Tech Publications; Switzerland.

Ivasishin et al.; Diffusion during powder metallurgy synthesis of titanium alloys; Defect and Diffusion Forum; Apr. 2008; pp. 177-185; vol. 277; Trans Tech Publications, Switzerland.

Ivasishin et al.; Fatigue Resistance of Powder Metallurgy Ti-6A1-4V Alloy; Strength of Materials; May 2004; pp. 225-230; vol. 36, Issue 3; Plenum Publishing Corporation.

Ivasishin et al.; The impact of diffusion on synthesis of high-strength titanium alloys from elemental powder blends; Key Engineering Materials; May 2010; pp. 113-121; vol. 436; Trans Tech Publications, Switzerland.

Ivasishin et al.; Microstructure and Properties of Titanium Alloys Synthesized from Hydrogenated Titanium Powders; From Shaw et al. (eds.) Science and Technology of Powder Materials:Synthesis, Consolidation and Properties; Mar. 2006; pp. 151-158; TMS (also in Materials Science & Technology; Sep. 2005; Maney).

Ivasishin et al.; Role of Surface Contamination in Titanium PM; Key Engineering Materials; Aug. 2012; pp. 121-132; vol. 520; Trans Tech Publications, Switzerland.

Ivasishin et al.; Synthesis of alloy Ti-6A1-4v with low residual porosity by a powder metallurgy method; Powder Metallurgy and Metal Ceramics; Jul. 2002; pp. 382-390; vol. 41, Issue 7-8; Plenum Publishing Corporation.

Ivasishin et al.; Titanium Powder metallurgy for automotive components; Materials Technology: Advanced Performance Materials.; 2002; pp. 20-25; vol. 17; Matrice Technology Ltd.

Li et al.; Dehydrogenation debinding process of MIM titanium alloys by TiH2 powder; Powder Metallurgy; Sep. 2006; pp. 236-239; vol. 49, No. 3; Institute of Materials, Minerals and Mining.

Pankevich; Production of titanium specimens from a titanium hydride powder by hot pressing; Soviet powder metallurgy and metal ceramics; Feb. 1986; pp. 89-92; vol. 25, Issue 2; Plenum Publishing Corporation.

Robertson et al.; Comparison of sintering of titanium and titanium hydride powders; Powder Metallurgy; Mar. 2010; pp. 12-19; vol. 53, Issue 1; Institute of Materials, Minerals and Mining.

Robertson et al.; Swelling during sintering of titanium alloys based on titanium hydride powder; Powder Metallurgy; Mar. 2010; pp. 27-33; vol. 53, No. 1; Institute of Materials, Minerals and Mining.

Taddei et al.; Densification and microstructural behavior on the sintering of blended elemental Ti-35Nb-7Zr-5Ta alloy; Materials Science Forum; Nov. 2006; pp. 341-346; vols. 530-531; Trans Tech Publications, Switzerland.

Wang et al.; A Critical Review of Mechanical Properties of Powder Metallurgy Titanium; International Journal of Powder Metallurgy; Jan. 2010; pp. 45-57; vol. 46, Issue 5; American Powder Metallurgy Institute.

Wang et al.; Titanium and Titanium Alloy via Sintering of TiH2; Key Engineering Materials; May 2010; pp. 157-163; vol. 436; Trans Tech Publications, Switzerland.

PCT Application PCT/US2011/061685; filing date Nov. 21, 2011; The University of Utah et al.; International Search Report; dated Jul. 2, 2012.

* cited by examiner

POWDER METALLURGY METHODS FOR THE PRODUCTION OF FINE AND ULTRAFINE GRAIN TI AND TI ALLOYS

RELATED APPLICATION(S)

This application is a continuation-in-part of U.S. patent application Ser. No. 14/062,590, filed Oct. 24, 2013, which is a continuation-in-part of PCT International Patent Application No. PCT/US2011/061685, filed Nov. 21, 2011, which claims priority to U.S. Provisional Application No. 61/479,177, filed Apr. 26, 2011, which are each incorporated herein by reference. This application also claims the benefit of U.S. Provisional Application No. 61/789,549, filed Mar. 15, 2013, which is incorporated herein by reference.

GOVERNMENT INTEREST

None.

BACKGROUND

Powder metallurgy (PM) has been regarded as a viable and promising approach for reducing the cost of Ti fabrication because of its near-net-shape capability and the potentially melt-less nature of the process. There are generally two kinds of powder metallurgy approaches for making PM titanium products: the blended elemental (BE) method and the pre-alloyed (PA) method. The BE method, in general, refers to the pressing and sintering of blended elemental powders. Sintering is generally carried out under vacuum. The PA method refers to sintering pre-alloyed powders, which are typically produced using gas atomization or plasma rotating electrode techniques. Pre-alloyed powders have high hardness and, therefore, poor press-ability when compacted using conventional, uni-axial, cold pressing methods. Therefore, pre-alloyed powders are usually consolidated using pressure assisted consolidation techniques, such as hot isostatic pressing (HIP). Although PA products, in general, have better mechanical properties than BE products, the costs of PA products are significantly higher. Therefore, BE is still the preferred cost-effective approach.

Residual porosity, oxygen contamination, and relatively coarse microstructure after sintering limit the static and fatigue properties of BE and PA materials. One approach for reducing residual porosity is to use post-sintering, high pressure processes, such as hot isostatic pressing, which can increase the density to greater than 99.8% of the theoretical density. Any post-sintering process, however, adds extra cost to BE parts, thereby reducing the cost advantages of the BE method.

In recent years, an alternative BE technique emerged for titanium production, which is able to produce nearly pore-free BE parts directly. This technique employs vacuum sintering of hydrogenated titanium or Ti hydride ($TiH_2$) powders instead of Ti metal powder. During sintering, $TiH_2$ will dehydrogenate at moderate temperatures and subsequently sinter at high temperatures under vacuum. Blends of $TiH_2$ with an appropriate ratio of 60Al-40V master alloy powder can be sintered to 98.5%-99.5% of the theoretical density in as-sintered state, in contrast to 90%-95% of the theoretical density when titanium powder was used. Although PM Ti parts produced by sintering using $TiR_2$ powder have shown great potential, the grain sizes of as-sintered materials are usually large. The as-sintered microstructure for Ti-6Al-4V consists of coarse Widmanstätten lamellar alpha plate colony structures, which have a coarse microstructure that is not optimal with respect to tensile or fatigue strength. The as-sintered coarse microstructures can be refined only by post-sintering thermal mechanical working and heat treatments, which, once again, increase the cost of PM Ti parts, reducing the economic benefits of PM Ti.

SUMMARY

In one aspect, a microstructure engineering approach is provided to produce PM titanium alloys with a fine grain microstructure, and other desired microstructure features. Such features lead to improved mechanical properties, without requiring subsequent processing steps, such as thermal mechanical working, cold working, or hot isostatic pressing (HIPing) after sintering.

In one aspect, a process for producing a sintered titanium material with fine grain size can include sintering a particulate titanium feed material in a hydrogen atmosphere with dynamically controlled hydrogen ($H_2$) partial pressure. The partial pressure of hydrogen during sintering at the elevated temperatures are generally greater than 0.01 atmosphere, and in some cases greater than 0.1 atmosphere. The particulate titanium feed material can include one or both of titanium metal (Ti) and hydrogenated titanium or Ti hydride ($TiH_2$). The dynamically controlled hydrogen atmosphere include hydrogen that is additional hydrogen not produced from the particulate titanium feed material. The particulate titanium feed material can be sintered at an elevated temperature to form a sintered titanium material containing hydrogen. The process can also include holding the sintered titanium material at a hold temperature below the sintering temperature and a hold time sufficient for phase transformations including eutectoid decomposition of the sintered titanium material. In addition, the sintered titanium material can be heated under vacuum or controlled inert atmosphere to dehydrogenate at a temperature which is less than the sintering temperature.

In another aspect, a material can be produced by the process described above. The material can contain titanium metal or titanium metal alloy.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF THE DRAWINGS

FIG. 5A is an SEM image of vacuum sintering of $TiH_2$, FIG. 5B is an SEM image of hydrogen sintering of $TiH_2$, FIG. 5C is a TEM image of hydrogen sintering of $TiH_2$, FIG. 5D is an SEM image of typical wrought processes and FIG. 5E is an SEM image of vacuum sintering of Ti metal powder, according to the examples.

Figure 1:
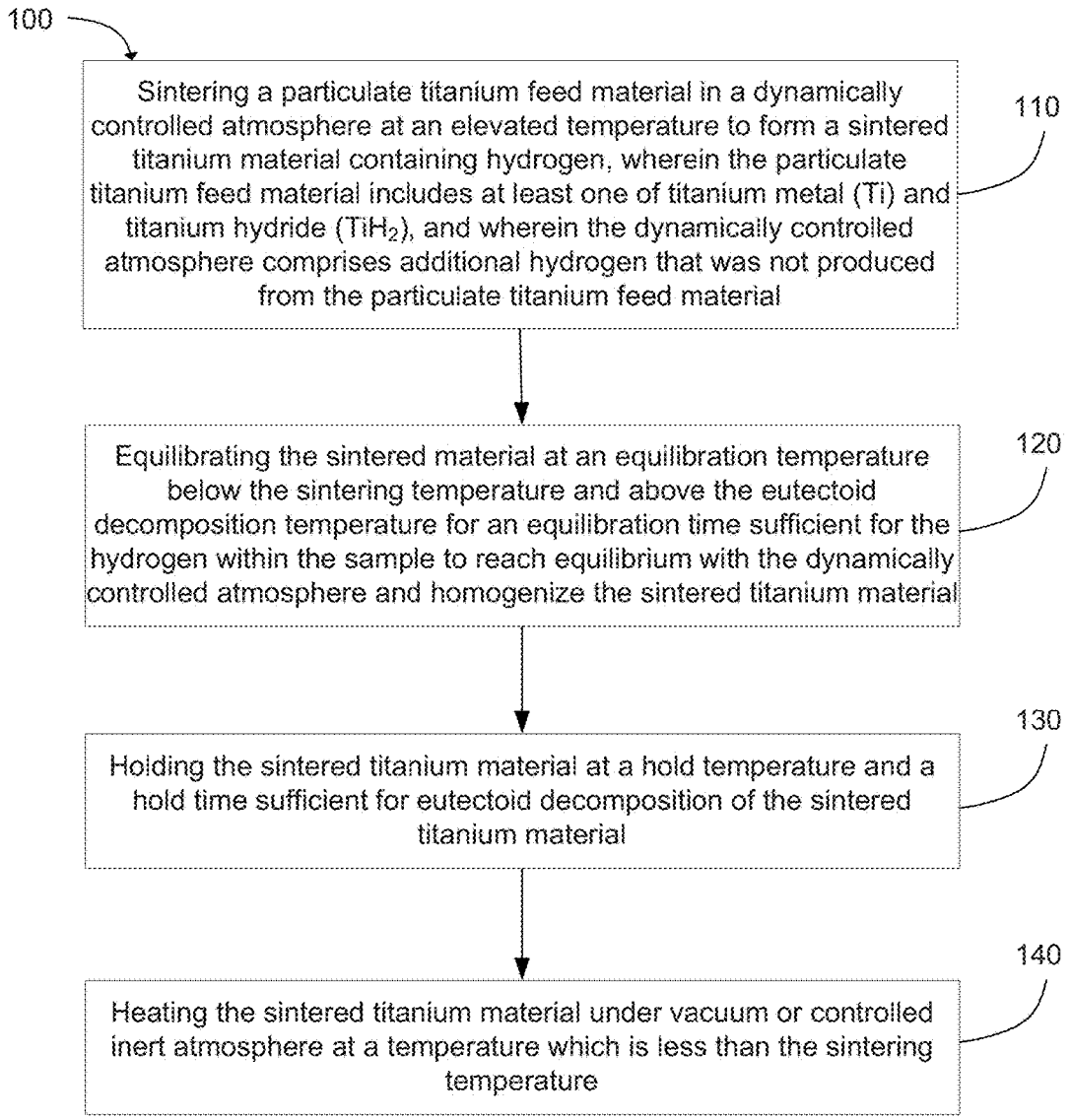
FIG. 1 is a flowchart of a process for producing a sintered titanium material with fine grain size according to one embodiment.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

As used herein, "fine and ultrafine" refer to grain sizes which range from about 5 μm to about 20 μm for fine grains, and less than 1 μm to about 5 μm for ultrafine grains. Most often grains sizes can be about 0.1 μm to about 3 μm.

As used herein, the terms "dynamically controlled hydrogen atmosphere" or "dynamically controlled $H_2$ partial pressure" are used to mean that the $H_2$ partial pressure can be held constant or varied as a function of time during each step in the thermal cycle. In any embodiment, $H_2$ partial pressure is dynamically controlled during sintering and phase transformations including eutectoid decomposition as a function of time and temperature in order to precisely control the microstructure of the as-sintered Ti or Ti alloy. The $H_2$ partial pressure is controlled by the addition or removal of $H_2$ from the atmosphere using mass flow controllers or pressure controllers. When hydrogenated titanium is used as all or part of the particulate feedstock material, $H_2$ will be naturally evolved during heating of the material. However, for this invention, it is important that the level of hydrogen be dynamically controlled beyond this natural occurrence by the addition or removal of additional $H_2$ gas. The partial pressure of hydrogen during sintering at the elevated temperatures can be greater than 0.01 atmosphere, and in some cases greater than 0.1 atmosphere. The degree of grain refinement due to phase transformations including eutectoid decomposition and dehydrogenation results from the changing phase equilibria between $\alpha$, $\alpha_2$, $\beta$, and $\delta$ phases of Ti and Ti alloys during processing. These phase equilibria change with temperature and with equilibrium hydrogen concentration, which varies as a function of temperature and $H_2$ partial pressure. Therefore, by dynamically controlling partial pressure of $H_2$ as well as temperature, phase evolution and, therefore, microstructure can be precisely controlled at each step of the process. The dynamically controlled hydrogen atmosphere can have partial pressures of $H_2$ between 0.01 atm and 10 atm, which are achieved by a mixture of $H_2$ and an inert gas at approximately 1 atm to 10 atm total pressure, pure $H_2$ at pressures approximately between 0.01 atm and 10 atm, or a fixed mixture of $H_2$ and inert gas at pressures between 0.01 and 20 atm. Therefore, partial pressure of $H_2$ is dynamically controlled by dynamically varying the gas ratio in the former example, or the absolute system pressure in the latter two. The partial pressure of $H_2$ can be controlled independently of any $H_2$ that is produced from the evolution of $H_2$ gas from hydrogenated titanium during sintering. Different $H_2$ partial pressure profiles can be used to tailor the mechanical properties of the as-sintered material by controlling the as-sintered microstructure.

As used herein, the term "near full density" refers to a minimization of porosity in the material, such that if full density were achieved, the density of the bulk material would be equal to that of the theoretical density of the material. As used herein, near full density refers to the material having a relative density of greater than 98%. As used herein, and as eluded to above, full density refers to the material having a relative density of greater than 99%. According to some embodiments, the titanium metal or the titanium metal alloy has a relative density greater than 97%. In other embodiments, the titanium metal or the titanium metal alloy has a near full density. In other embodiments, the titanium metal or the titanium metal alloy has a full density.

As used herein, the term $\alpha$-phase refers to a hexagonal close-packed (HCP) solid solution of Ti with alloying elements. The $\alpha$-phase may or may not contain some hydrogen. The term $\beta$-phase refers to a body-centered cubic (BCC) Ti solid solution with alloying elements, which may or may not also contain hydrogen. The term $\delta$-phase refers to a face-centered cubic (FCC) hydrogenated titanium or Ti hydride, $TiH_x$, where x varies from 1.5 to 2, at room temperature. The term $\alpha_2$ refers to $Ti_3Al$ phase which is an ordered hexagonal structure in $\alpha$ phase with DO19 crystal structure. The definitions of the phases are further illustrated by the phase diagrams of Ti—H, and Ti-6Al-4V—H (ASM Handbook, Vol 3, p238, 1992). It should be noted that the phase diagrams of titanium alloys with hydrogen vary considerably within the scientific literature and are not yet completely characterized. Therefore, the exact temperatures and time of sintering, isothermal holding for eutectoid transformation, and dehydrogenation will all vary accordingly.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The use of the terms "a" and "an" and "the" and similar referents in the context of describing the elements (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Additionally the phrase "consisting essentially of" will be understood to include those elements specifically recited and those additional elements that do not materially affect the basic and novel characteristics of the claimed invention. The phrase "consisting of" excludes any element not specifically specified.

The present disclosure is not to be limited in terms of the particular embodiments described in this application. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

Fine and Ultrafine Grain Titanium Materials

A process is provided for producing titanium and titanium alloys with near-full and full density and fine or ultrafine grain sizes in an as-sintered state without, or with minimal, post-sintering processing. The ultrafine grain and near-porosity-free microstructure of the resulting material allows for flexibility in custom engineering of the microstructure of titanium materials. The near porosity-free ultrafine microstructure is achieved by sintering under a dynamically controlled hydrogen atmosphere with a partial pressure of $H_2$ greater than 0.01 atm at high temperatures (>1000° C.) during sintering densification, followed by subjecting the material to phase transformations and dehydrogenation at moderate temperatures (20-1000° C.). The dynamically controlled hydrogen pressure is selected based on considerations of the equilibrium pressure as a function of the temperature and desired final microstructure which can be affected by the hydrogen content in the titanium or titanium alloy. The thermal cycle is designed such that the phase transformations during the eutectoid transformation and dehydrogenation are controlled so that they lead to ultrafine microstructure features without significant grain growth. Through the present process, powder compacts of hydrogenated titanium or Ti hydride with or without metallic titanium and/or alloying elements (e.g. Ti-6Al-4V), can be sintered to full density (>99% relative density) with grain sizes under 10 micrometer (μm).

As illustrated in FIG. 1, a process 100 for producing a sintered titanium material with fine grain size can include three primary steps: First, step 110 includes sintering a particulate titanium feed material in a dynamically controlled hydrogen atmosphere at an elevated temperature to form a sintered titanium material containing hydrogen, wherein the particulate titanium feed material includes at least one of titanium metal (Ti) and hydrogenated titanium or Ti hydride ($TiH_2$), and wherein sintering temperature is greater than 1000° C., and wherein the dynamically controlled hydrogen atmosphere comprises additional hydrogen that was not produced from the particulate titanium feed material, and wherein the partial pressure of hydrogen during sintering at the elevated temperatures are greater than 0.01 atmosphere, and most often greater than 0.1 atmosphere. More specifically, the hydrogen atmosphere can comprise primarily additional hydrogen that is not produced or liberated from the feed material. Thus, more hydrogen is supplied from an external source than is formed from feed material. Second, step 130 includes holding the sintered titanium material at a hold temperature that is below the sintering temperature and a hold time sufficient for phase transformations including eutectoid decomposition of the sintered titanium material. Finally, step 140 includes heating the sintered titanium material under vacuum or controlled inert atmosphere at a temperature which is less than the sintering temperature. Optionally, step 120 can include equilibrating the sintered material at an equilibration temperature below the sintering temperature and above the phase transformations including eutectoid decomposition temperature for an equilibration time sufficient for the hydrogen within the sample to reach equilibrium with the dynamically controlled hydrogen atmosphere and homogenize the sintered titanium material.

The particulate titanium feed material can be provided in powder form. For example, Ti powder and $TiH_2$ powder are commercially available. The particulate titanium feed material can be sintered together with alloying additives. These alloying additives can also be provided in powder form. Suitable alloying additives can include aluminum, carbon, chromium, cobalt, copper, gallium, germanium, iron, manganese, molybdenum, nickel, niobium, nitrogen, oxygen, palladium, ruthenium, silicon, tantalum, tin, vanadium, zirconium, hafnium, and mixtures or alloys thereof, such as the commercially available 60Al-40V alloy. Particulate titanium feed materials and alloying additives can be mixed together in ratios corresponding to a desired alloy composition for the final sintered material. For example, in some embodiments the mixture can have the composition of Ti-6Al-4V alloy.

The particulate feed material can consist of particulate titanium and/or hydrogenated titanium that has or has not been previously alloyed with the required elements for the alloy (e.g. aluminum and vanadium for Ti-6Al-4V) as well as particulate alloying elements that are in the form of individual powders or pre-alloyed "master alloys" (e.g. 60Al/40V master alloy for Ti-6Al-4V). The particulate titanium and alloying element feed materials may be provided in commercially available powders that are produced from virgin metal using any of the extractive process used in commercial titanium production including, but not limited to, the Kroll Process, the Armstrong Process, the Hunter Process, etc. The particulate titanium and alloying element feed materials may come from materials that are traditionally considered by-products of commercial titanium production processes, such as "sponge fines" from the Kroll Process. The particulate titanium and alloying element feed materials may come from scrap that is produced during milling, machining, or recycling of metals. The particulate titanium and alloying element feed materials may come from a combination of the aforementioned sources. In one embodiment, the particulate titanium and alloying element feed materials can be produced by hydrogenating Ti-6Al-4V machine turning and ball milling to an appropriate size and morphology for compaction and sintering.

The powders of titanium feed material and the alloying additives can have a variety of particle sizes. In one embodiment, the powder can have a size from about 20 mesh to about 1200 mesh (or 841 to 12 micrometers). In another embodiment, the powder can have a size of from about 100 mesh to about 325 mesh (or 149 to 44 micrometers). In another embodiment, the powder can have a size of about 200 mesh to about 325 mesh (or 74 to 44 micrometers). In another embodiment, the powder can have a size of about 400 mesh. In another embodiment, the powder can have a size of from about 325 mesh to about 450 mesh (or 44 to 32 micrometers), and in another case to about 400 mesh. In another embodiment, the powder can have a size of from about 325 mesh to about 635 mesh (or 44 to 20 micrometers). In another embodiment, the powder can have a size of from about 325 mesh to about 1200 mesh (or 44 to 10 micrometers). In another embodiment, the powder can have a size of from about 450 mesh to about 635 mesh (or 32 to 20 micrometers). In another embodiment, the powder can have a size of from about 400 mesh to about 1200 mesh (or 37 to 10 micrometers). In one optional embodiment, the particulate titanium feed material can be prepared by combining corresponding powders with average particle sizes greater than 20 μm with a non-volatile liquid to form a slurry. The slurry mixture can be subjected to size reduction processing (e.g. mechanical or other techniques) to produce powders with average particle sizes less than 20 μm, such as submicron to 20 μm. After the size reduction processing, the slurry can be dried or drained to remove excess liquid and powder particles of which the surface is coated by the non-volatile liquid and isolated from surrounding air or other gaseous atmosphere are collected.

In some embodiments of the present process, coarse powders of titanium feed material and alloying additives can be used. Usually, the coarser the initial powder, the lower the final oxygen content of the material. When using traditional powder metallurgy methods to make titanium components from titanium metal powders, coarse powders tend to be very difficult to consolidate, and also lead to coarse final microstructure with detrimental levels of residual porosity. In contrast, fine Ti metal powders are prone to oxygen contamination. The present technology allows for use of a coarse $TiH_2$ powder as the starting raw material, thereby making it easier to control oxygen content in the subsequent powder pressing, forming, sintering, and dehydrogenation steps, while coarse $TiH_2$ powder poses few difficulties in densification to near full density provided that proper powder processing and compaction techniques are used. The use of finer powders may still result in the lowest porosity levels, smaller pores, and highest density, and may be used in the stated process. The use of coarse powders in the present process does not lead to coarse final grain microstructure because of the controlled stages of densification during sintering and phase transformation. The grain size of the final material is not strongly affected by the initial particle size of the powder because the grain size is primarily a function of the temperature versus time profiles and partial pressure of $H_2$ versus time profiles of the sintering, phase transformations including eutectoid decomposition, and dehydrogenation steps. Therefore, the present process can produce strong sintered titanium materials with lower oxygen content at a lower cost than traditional powder metallurgy approaches.

In order to reduce residual porosity to its lowest levels and minimize the size of the residual pores in produced materials, a finer starting powder size may be desirable, while retaining the lowest possible oxygen levels. In one embodiment, powders of hydrogenated titanium or Ti hydride, possibly with titanium and other alloying elements, can be milled to finer sizes with a protective coating of a non-volatile liquid. Suitable non-volatile liquid can substantially coat the powders to prevent oxidizing during milling. This non-volatile liquid can be an organic liquid such as a natural or synthetic oil such as mineral oils, an ionic liquid, or a mixture of these liquids. In this procedure, the powders are mixed with a selected non-volatile liquid between $1/20^{th}$ and 20 times the volume of the powder, and then subjected to a particle size reduction process. For example, the powder can be milled in any of a range of milling devices, including but not limited to: drum mills, roller mills, hammer mills, vibration mills, jet mills, attritor mills, or planetary mills. The powder and liquid mixture may or may not be under a protective cover gas of argon or other inert gas. The milled powder slurry can be dried or drained to remove excess liquid. Powder particles of which the surfaces are coated by the non-volatile liquid and isolated from the air or other gaseous atmosphere can then be collected for subsequent processing.

Before sintering, the titanium feed material and alloying additive powders can be formed into a compact in the approximate shape of the final sintered part. First, the powders can be intimately mixed by blending or powder milling. Then the powders can be formed into a powder compact. In one embodiment, this can be done using a cold isostatic press. Powders can be cold isostatically pressed at a sufficient pressure to form a powder compact of the desired shape that can subsequently be sintered. The press can use a compacting pressure ranging from 100 MPa to 500 MPa. In one embodiment, the compacting pressure can be about 350 MPa. In another embodiment, powders can be pressed in a uniaxial die press to form a powder compact of the desired shape that can be subsequently sintered. The press can use a compacting pressure ranging from 100 MPa to 1 GPa. In one embodiment, the compacting pressure can be about 350 MPa. In another embodiment, powder compacts can be manufactured using injection molding by mixing the powders with 10% to 60% binder by volume, heating to an appropriate temperature to sufficiently melt the binder, and injecting into a die of the desired geometry. After injection molding, the compact can be extracted from the die and the binder removed before sintering. The binder may be removed by submersing the compact in a suitable solvent to dissolve the binder, heating to a sufficient temperature to evaporate or thermally decompose the binder along with any residual milling liquids, or a combination of both methods. Suitable binders can consist of a mixture of one or more of a polymer component and/or a wax component. In one embodiment, a 1:1 ratio by volume of polyethylene glycol and paraffin wax can be used as the binder. In another embodiment, powders can be formed into the desired shape for sintering without the use of compaction. This method consists of filling a refractory ceramic or metallic mold of the desired geometry with loose powder, tapping or vibrating the mold until the powder settles to at or near its tap density, and loading the mold into a furnace for sintering. If the morphology of the powder is such that reasonable particle-to-particle contact is achievable at tap density, the rapid diffusion of titanium in the presence of hydrogen results in greater than 99% density without pressure-assisted compaction. The latter technique has been termed "powder casting" based on its similarity to traditional liquid metal casting.

One or more of the sintering, equilibrating, and phase transformations including eutectoid decomposition steps can be performed under a dynamically controlled hydrogen atmosphere. The dynamically controlled hydrogen atmosphere contains primarily hydrogen that was not produced from the particulate titanium feed material. In traditional approaches to sintering $TiH_2$, hydrogen gas can often be liberated from the titanium material during sintering at a high temperature. When sintering is performed under a vacuum, the titanium material can often be completely dehydrogenated during the sintering process. In such a process, the atmosphere surrounding the titanium part during sintering is a near-vacuum with only a small pressure of hydrogen as the hydrogen is driven off from the titanium. In processes according to the present technology, however, the sintering step can be performed under a dynamically controlled hydrogen atmosphere that primarily includes hydrogen from an external source. This dynamically controlled hydrogen atmosphere can be used to control the concentration of hydrogen in the titanium material during sintering, equilibrating, and phase transformations including eutectoid decomposition.

Controlling the hydrogen pressure during sintering, equilibration, and phase transformations including eutectoid decomposition can allow for high sintered densities and fine grain sizes in the final titanium material. In some embodiments of the present technology, the sintering can be performed under an atmosphere with an appropriate pressure of hydrogen such that the titanium material remains in a β-Ti(H) solid solution phase region during sintering. In such embodiments, the material is a solid solution of β-phase titanium with hydrogen at the sintering temperature, rather than a pure titanium metal as would be the case under a vacuum. The inventors have found that titanium can be sintered to very high density at high temperatures, e.g. in the β-phase region, under controlled hydrogen partial pressure with significant hydrogen content in the metal. Without being limited to one particular mechanism, it is believed that self-diffusion of the titanium in the β-Ti phase is significantly faster than in the α-Ti phase, and a solid solution of hydrogen atoms in titanium can reduce the activation energy of Ti self-diffusion due to the presence of Ti—H bonds, which have a significantly decreased bond strength in relation to Ti—Ti bonds. It is believed that each of these effects helps to achieve full densification during β-Ti(H) sintering.

It is important to note that being able to sinter titanium in a dynamically controlled hydrogen atmosphere is a significant discovery. Conventionally, titanium is sintered in vacuum in order to achieve high density and low oxygen. Sintering of titanium under argon atmosphere often produces a product with unacceptable residual porosity and oxygen levels. In addition to allowing for improved microstructure and mechanical properties, sintering titanium in a partial hydrogen atmosphere can also allow for continuous production of powder metallurgy titanium parts, as opposed to batch processing as is often used in conventional vacuum sintering. The present process is not limited to continuous processing. The cost savings of the present process could be considerable over traditional processing, even as a batch process. Additionally, it may be advantageous to employ this process as a batch process to allow for minimal capital expenses or the ability to change temperature and hydrogen partial pressure profiles between batches.

The dynamically controlled hydrogen atmosphere can include pure hydrogen or a mixture of hydrogen and an inert gas, such as helium, argon, or xenon. The partial pressure of hydrogen can typically be between 0.01 atm and 10 atm. In some embodiments, the dynamically controlled hydrogen atmosphere has a hydrogen to inert gas ratio from about 1:100 to about 1:0. The total pressure of hydrogen with the inert gas can be any pressure, but in many embodiments the total pressure can be between about 0.01 atm and 10 atm of absolute pressure. Therefore, the partial pressure of hydrogen may be controlled by, but not limited to, one of several methods. In one method, the absolute pressure of the system is constant and the partial pressure of hydrogen is controlled using two programmable gas mass flow controllers; one being connected to a supply of hydrogen and the other to a supply of inert gas. The partial pressure of hydrogen is increased by increasing the volume fraction of hydrogen flowing into the system and vice versa. In another method, the partial pressure of hydrogen is controlled by controlling the absolute pressure of the system using a programmable pressure controller with an inlet valve to increase absolute pressure and an exhaust valve to decrease absolute pressure. The inlet valve of the pressure controller is connected to a supply of either pure hydrogen or a mixture of hydrogen and inert gas with a fixed ratio. Additionally, a hybrid method may be used where the volume fraction of hydrogen on the inlet valve of the pressure controller is controlled using two programmable gas mass flow controllers. In any method, the partial pressure of hydrogen is equal to the product of the absolute pressure of the system and the overall volume fraction of hydrogen in the system. In some embodiments, the absolute pressure of the system can be maintained at a substantially constant controlled absolute pressure. However, controlling the pressure can involve merely maintaining pressure within the desired hydrogen partial pressure ranges. Under conditions using pure hydrogen (i.e. the hydrogen atmosphere consists essentially of hydrogen), the corresponding process pressure can be at a controlled absolute pressure corresponding to the above recited hydrogen partial pressures. Specifically, pure hydrogen can generally be from 0.01 atm to 10 atm.

In some embodiments, the dynamically controlled hydrogen atmosphere can be varied throughout the sintering, equilibrating, and phase transformations including eutectoid decomposition steps to offer further microstructural control. Exact hydrogen pressure can be selected based on the equilibrium pressure as a function of the temperature and the desired hydrogen content necessary to produce a particular microstructure. More specifically, as temperature decreases, equilibrium pressure of hydrogen gas over the surface of titanium with a given concentration of dissolved hydrogen decreases. Therefore, the sintered material will absorb additional hydrogen at lower temperatures given a constant partial pressure of hydrogen. As such, the dynamically controlled hydrogen atmosphere can include a hydrogen partial pressure which is varied during the process in order to achieve a target hydrogen concentration within the sintered titanium material as a function of time. For example, if a constant hydrogen content is desired then as temperature decreases, the partial pressure of hydrogen would also be decreased commensurate with the equilibrium pressure. Alternatively, the hydrogen content can be varied as a function of time throughout the process to achieve the desired microstructure. In one embodiment, the hydrogen partial pressure is kept at 1 atm during the sintering step to maintain elevated levels of hydrogen within the titanium during sintering, the atmosphere is then gradually changed to 0.5 atm of hydrogen as the sample cools to the phase transformations including eutectoid decomposition temperature to prevent excessive absorption of hydrogen. In any embodiment, if the equilibrium pressure of the titanium-hydrogen system, which is a function of temperature and hydrogen content of the titanium, is different than partial pressure of hydrogen in the atmosphere, hydrogen evolution or absorption will occur. Therefore, it is important to use one of the methods described above, or a similar method, to control the partial pressure of hydrogen throughout the process to prevent excessive evolution or absorption. Using Ti-6Al-4V as an example, under a partial hydrogen pressure, blended powder can be sintered to near full density with a microstructure having one, two, three, or four phases including alpha ($\alpha$), alpha-2 ($\alpha_2$), delta ($\delta$) and beta ($\beta$) phases after cooling to room temperature.

After the sintering step, the phase transformations including eutectoid decomposition can also be performed under a dynamically controlled hydrogen atmosphere containing hydrogen. Controlling the hydrogen content in the titanium material during the eutectoid phase transformation from $\beta$-phase to $\alpha$-, and $\delta$-phases can allow for titanium materials with very fine microstructure without resorting to thermo mechanical working that relies on recrystallization to control grain sizes. The equilibrium transformation temperature decreases and the kinetics of the transformation reaction slow with increasing hydrogen concentration. Additionally, the hydrogen concentration is a function of temperature and partial pressure of hydrogen in the atmosphere. Therefore, the thermodynamics and kinetics of the phase transformations are dependent not only on temperature (as is the case with most metallurgical processes), but also on the partial pressure of hydrogen in the atmosphere. In some embodiments, the partial pressure of hydrogen used during sintering could result in excessive uptake of hydrogen at the decomposition temperature, which would result in reduced undercooling and slowed kinetics. Conversely, in these embodiments, a simultaneous decrease of hydrogen partial pressure during cooling can prevent an inordinate uptake of hydrogen. Decreasing the partial pressure could result in a greater degree of undercooling and faster kinetics at the decomposition temperature, which would, in turn, result in a finer microstructure due to more homogenous nucleation and a greater degree of reaction completion per unit time. This phenomenon gives the process another parametric degree of freedom and, therefore, greater control over microstructural evolution. In one embodiment, the hydrogen partial pressure can gradually decreased from 1 atm of pure hydrogen at the sintering temperature to 0.5 atm hydrogen and 0.5 atm of inert gas at the decomposition temperature. The atmosphere can then be abruptly changed to 1 atm of inert gas with no hydrogen immediately before cooling to prevent excessive absorption of hydrogen.

In some embodiments, the partial pressure of hydrogen in the dynamically controlled hydrogen atmosphere can change with each step. For example, in one embodiment the process can include sintering blended powders of $TiH_2$ and alloying powders in a dynamically controlled hydrogen atmosphere with a first partial pressure of hydrogen, cooling and holding for phase transformations including eutectoid decomposition under a second partial pressure of hydrogen, and then switching the atmosphere condition to vacuum, inert gas, or a combination of both to dehydrogenate the material. In other embodiments, a single partial pressure of hydrogen can be used throughout the sintering, equilibrating, and phase transformations including eutectoid decomposition steps. Furthermore, the partial pressure of hydrogen can be changed multiple times within a single step, or the partial pressure can be gradually ramped up or down over the duration of a step.

Figure 2A:
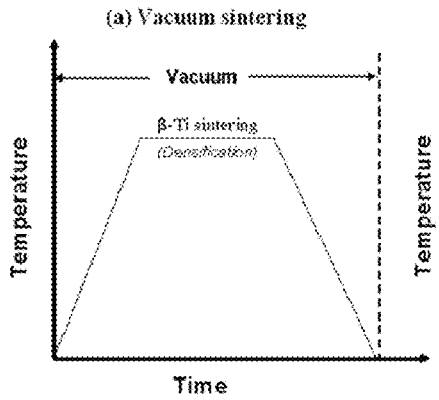
FIG. 2A is a graphical representation of an illustrative temperature vs. time cycle for titanium production using vacuum sintering.
Figure 2B:
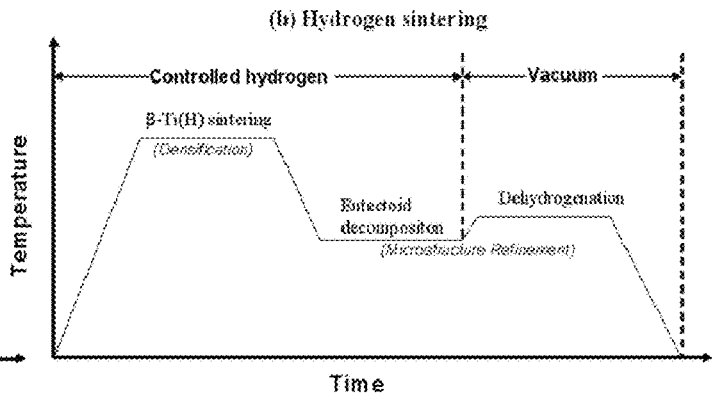
FIG. 2B is a graphical representation of an illustrative temperature vs. time cycle for titanium production using hydrogen sintering, according to one embodiment.

The elevated sintering temperature can be any temperature that corresponds to the $\beta$-phase region with a given hydrogen content. One of skill in the art will appreciate that the temperatures and compositions that fall within the $\beta$-phase region can be different for pure titanium and various alloys of titanium with other metals. A graph of temperature vs. time for an exemplary embodiment is shown in FIG. 2. In this embodiment, the process consists of three steps: (1) $\beta$-Ti(H) sintering, (2) phase transformations including eutectoid decomposition, and (3) dehydrogenation in vacuum, an inert gas such as Ar, or a combination of vacuum and an inert gas. FIG. 2 illustrates the ramping up and down of the temperature in each of the steps and the hold periods that can be used. Note that the steps can be completely separated as separate processes conducted in different runs, or as a single integrated continuous run. Without being bound by theory, the following steps describe what are believed to be the phase transitions that occur to produce titanium and titanium alloys having fine grain size.

In the first step of $\beta$-Ti(H) sintering, by controlling the $H_2$ atmosphere, the process maintains sintering in $\beta$-Ti phase region. Self-diffusion of the titanium in the $\beta$-Ti phase is significantly faster than in the $\alpha$-Ti phase, and a solid solution of hydrogen atoms in titanium can reduce the activation energy of Ti self-diffusion due to the decrease of bonding strength due to the presence of comparatively weak Ti—H bonds. It is believed that each of these effects helps to achieve full densification during β-Ti(H) sintering.

In one exemplary embodiment, the sintered titanium material can be Ti-6Al-4V alloy. Under the partial hydrogen pressure, a blended powder can be sintered to near full density with a microstructure having one, two, three, or four phases including alpha (α), alpha-2 ($\alpha_2$), delta (δ) and beta (β) phases after cooling to room temperature. The elevated temperature at which sintering occurs can be from about 1000° C. to about 1500° C. In one particular embodiment the elevated temperature can be about 1200° C. The sintering is also conducted for a time period sufficient to gain near full density. For example, the material can be held at the elevated temperature from about 1 hour to about 24 hours. In some embodiments, the sintering time can vary from about 30 minutes to about 30 hours. In other embodiments, the sintering can be performed from about 1 hour to 24 hours. In one particular embodiment, the sintering time can be about 2 hours.

The sintering can be conducted in any chamber in which the temperature and atmosphere can be controlled. For example, the sintering can be conducted in a furnace which is capable of attaining a working temperature of up to 1500° C. or even higher, is capable of being used under vacuum, and is capable of using gases such as hydrogen, argon, nitrogen, and the like, or a mixture of any two or more such gases. In one particular embodiment, the furnace can be an alumina tube furnace. In another embodiment, the furnace can be a refractory metal alloy including, but not limited to, a Fe—Cr—Al alloy. The heating elements of the furnace can be made of such materials as are known in the art, including, but not limited to, tungsten or molybdenum mesh, silicon carbide, or $MoSi_2$.

After sintering, an optional intermediate equilibration step can be introduced in order to allow hydrogen partial pressure to be adjusted dynamically to facilitate the following phase transformations including eutectoid decomposition step. In some embodiments this equilibrating step can include holding the sintered titanium material at a temperature above the β-transus prior to phase transformations including eutectoid decomposition to allow hydrogen within the sample to reach the required equilibrium concentration necessary for a desired phase evolution during phase transformations including eutectoid decomposition. The equilibration temperature can be below the sintering temperature and above the phase transformations including eutectoid decomposition temperature. The equilibration temperature can vary between about 300° C. and about 1000° C. Typically, the equilibration temperature for Ti-6Al-4V alloy can be from about 870° C. to about 900° C. The equilibration temperature can vary from one alloy composition to another. The temperature can be held constant, or nearly constant, during this step for from about 10 minutes to about 12 hours. The equilibration time can be sufficient for the hydrogen within the sample to reach equilibrium with the dynamically controlled hydrogen atmosphere and homogenize the sintered titanium material.

Optionally, an additional cooling step can be performed in which the sintered titanium material is cooled from the elevated sintering temperature to the equilibration temperature at a non-uniform rate. Another optional step prior to the phase transformations including eutectoid decomposition step can be performed in which the sintered titanium material is cooled from the equilibration temperature to the phase transformations including eutectoid decomposition hold temperature at a non-uniform rate. In one embodiment, the material can be cooled from the sintering temperature to the equilibration temperature at a rate of 10° C./min. After a sufficient amount of time for equilibration to a desired hydrogen content, the material can be cooled from the equilibration temperature to the decomposition temperature at a non-uniform rate, beginning at 10° C./min and decreasing to about 1° C./min as the target temperature is approached. A non-uniform temperature change rate can allow for increased microstructural control due to the diffusion of hydrogen that is being absorbed during temperature change as well diffusion of alloying elements being segregated to their respective phases during phase transformation.

The phase transformations including eutectoid decomposition step can be performed by holding the sintered titanium material at a hold temperature and a hold time sufficient for phase transformations including eutectoid decomposition of the sintered titanium material. In some embodiments, the phase transformations including eutectoid decomposition step is conducted at a temperature from about 200° C. to about 900° C. The temperature can be below the β-phase transition temperature for whatever particular composition of Ti, H, and other alloying additives is being used. In some embodiments, the material can be held at the phase transformations including eutectoid decomposition hold temperature for a hold time from about 10 minutes to about 120 hours.

Referring again to FIG. 2, the phase transformations including eutectoid decomposition step is shown between the sintering step and the dehydrogenation step. The sintered material can be cooled in the dynamically controlled $H_2$ atmosphere to a phase transformations including eutectoid decomposition temperature below the β-transus. The material can then be held at this temperature for a period of time to complete the eutectoid reaction. As used herein, the term "eutectoid reaction" refers to the formation of new phases (α-Ti(H)+δ-$TiH_x$) that precipitate in the interior of β-Ti(H) grains in the sintered material. As a result, the coarse β-Ti(H) grains break into finely dispersed (α-Ti(H)+$\alpha_2$+β-Ti(H)+δ-$TiH_x$) grains, thereby refining the microstructure.

The holding temperature and holding time for the phase transformations including eutectoid decomposition step can be sufficient to allow decomposition to take place and form a eutectoid decomposed material. For example, the temperature can range from about 150° C. to about 900° C. depending on exact alloy compositions. In some embodiments, the temperature can range from about 400° C. to about 800° C. for Ti-6Al-4V alloy and about 150° C. to about 400° C. for commercially pure titanium. The time period for phase transformations including eutectoid decomposition can be sufficient for the process to proceed sufficiently toward completion. For example, the temperature can be held constant, or nearly constant, from about 10 minutes to about 120 hours. In other embodiments, the temperature can be held constant, or nearly constant, from about 10 minutes to about 12 hours, from about 30 minutes to about 6 hours, from about 1 hour to about 24 hours, or from about 1 hour to about 12 hours.

After the phase transformations including eutectoid decomposition step, the sintered titanium material can be re-heated under vacuum or inert gas to dehydrogenate. The dehydrogenation temperature can be below the sintering temperature. The temperature for dehydrogenation in vacuum or inert gas can typically be from about 400° C. to about 900° C., below the β-phase transition temperature. The sintered titanium material can be held at the dehydrogenation temperature from about 2 hours to about 100 hours depending on the size of the components.

Referring again to FIG. 2, the dehydrogenation step is shown after the phase transformations including eutectoid decomposition step. During the step of dehydrogenation in vacuum and/or an inert atmosphere, the hydrogen atoms in the titanium are removed. The phase transformations during dehydrogenation further refine and modify the microstructure. The final fine grain microstructure can be formed during this step. According to various embodiments, if the material is a Ti-6Al-4V alloy, such fine grain microstructure includes both α-phases and β-phases. Without being bound by theory, the dehydrogenation process is believed to decompose the δ-phase and release the hydrogen in the material. During the dehydrogenation process, the δ-phase transforms to a α+β phase mixture. Hydrogen then diffuses through the material to the surface, where it escapes as hydrogen gas.

The re-heating of the material can be conducted for a time period sufficient to reduce hydrogen content in materials to less than 150 ppm. Generally, hydrogen can be removed to a level much lower than allowable levels according to ASTM standards (150 ppm). For example, the residual hydrogen content after conventional vacuum sintering of $TiH_2$ or thermohydrogen processing (THP) can be as low as 10 ppm, which is not detrimental to the mechanical properties of titanium materials. The hydrogen content of materials prepared using the processes of the present invention can be nearly as low. For example, in one embodiment the hydrogen present after performing the present process using vacuum during dehydrogenation has been measured at or below 30 ppm, and at or below 60 ppm when using Ar atmosphere during dehydrogenation. These are both well below the ASTM standard of 150 ppm. The time for dehydrogenation can vary depending on the size of the part being formed or the components used. The dehydrogenation step can be conducted by holding the material at the dehydrogenation temperature for from about 1 hour to about 100 hours. The actual time required is governed by the law of diffusion. According to some embodiments, dehydrogenation can be performed from about 10 to about 24 hours. In other embodiments, the dehydrogenation time can be from about 1 to about 20 hours. The dehydrogenation can be conducted in the same chamber as the initial sintering, or in a separate furnace chamber in which the temperature and atmospheric pressure and composition can be controlled.

The steps of sintering in the dynamically controlled hydrogen atmosphere, phase transformations including eutectoid decomposition in the dynamically controlled hydrogen atmosphere, and the dehydrogenation under vacuum, inert gas, or a combination of both, can be three separate processes, or they can be integrated in a single process. Alternatively, the sintering and phase transformations including eutectoid decomposition steps can be processed in sequence with the dehydrogenation step following later, or just the sintering step can be completed with the phase transformations including eutectoid decomposition and dehydrogenation steps being processed together later. In one embodiment, a single, integrated process of all three steps can be performed as shown in FIG. 2. This embodiment can include sintering blended powders of $TiH_2$ and alloying powders in a dynamically controlled hydrogen atmosphere with a partial pressure of hydrogen ($H_2$) gas, cooling and holding for phase transformations including eutectoid decomposition under the same or different partial pressure of $H_2$, and then switching the atmosphere condition to vacuum, inert gas, or a combination of both at certain temperatures to perform the dehydrogenation step. In another embodiment, after the sintering step, the parts are subjected to the dehydrogenation step directly without specifically holding for phase transformations. The parts may be cooled to room temperature before heating up to the dehydrogenation temperature, or the parts may be cooled from the sintering temperature to the dehydrogenation temperature directly without interruptions.

In any of the above embodiments, the process can be void of mechanical processing steps after sintering. As used herein, the term "mechanical processing steps" refers to forging, rolling, extrusion, drawing, swaging, and the like as known in the art. Mechanical processing steps are those steps where the material is deliberately deformed plastically at either elevated (thermomechanical or hot working) or room temperatures (cold working). In a conventional process including mechanical processing steps, after the plastic deformation of cold working, or during hot working the microstructure of the material can be transformed at elevated temperatures via recrystallization to achieve a desired microstructure. In the processes of the present invention, the desired fine grain microstructure is formed in situ during the integrated sintering-phase transformations including eutectoid decomposition-dehydrogenation process. In some cases, thermal mechanical working can be done after the process to further enhance the properties. However, by using the processes of the present invention, strong titanium materials with fine microstructures can be produced without the need for further mechanical processing steps after sintering.

The titanium metal or titanium metal alloys obtained from the process can have a fine or ultrafine grain size (i.e. average grain size). Such ultrafine grain sizes on the microscopic scale provide for high strength and ductility in the macro scale materials. The use of coarse powders in the process does not lead to coarse final grain microstructure because of the controlled stages of densification and phase transformation. The grain sizes of the final material do not depend as much on the initial particle size of the powder as does the titanium metal powder, but rather the grain size is primarily a function of the kinetics of phase transformation and the temperature versus time profiles as well as partial pressure of $H_2$ versus time profiles during the sintering, phase transformations including eutectoid decomposition, and dehydrogenation steps. In any of the above embodiments, the titanium metal or the titanium metal alloy obtained from the process can have a grain size of less than 100 μm. In some embodiments, the titanium metal or titanium metal alloy prepared using the above process can have a grain size of less than 10 μm. In some embodiments, the titanium metal or titanium metal alloy prepared using the above process can have a grain size of less than 20 μm and in some cases less 5 μm. In other embodiments, the titanium metal or the titanium metal alloy can have a grain size of from about 10 nm to about 10 μm. In other embodiments, the titanium metal or the titanium metal alloy can have a grain size of from about 10 μm to about 100 μm. These grain sizes and other properties recited herein are typically obtained directly from the process without further post-processing (i.e. as-sintered). Note the term as-sintered can be used to encompass the step of sintering at the high temperatures in hydrogen or all three steps of the process including sintering in hydrogen, phase transformations, and dehydrogenation. Accordingly, in some cases the process can consist essentially of sintering, holding to cause eutectoid decomposition, and heating to cause dehydrogenation.

Figure 5A:
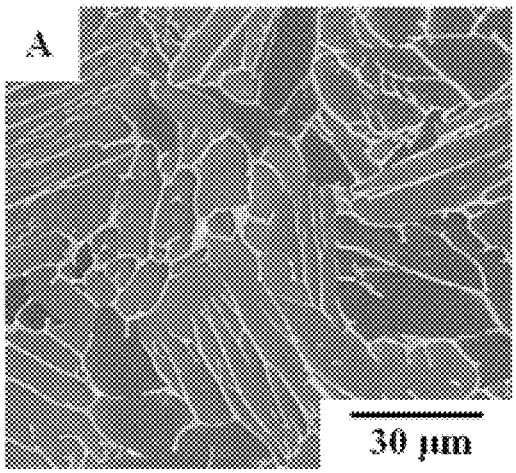
FIG. 5A-5E is a group of SEM and TEM micrographs showing the microstructures produced by various processes, where
Figure 5B:
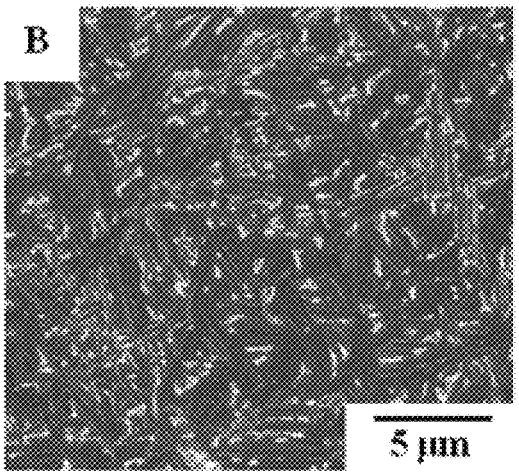
Figure 5C:
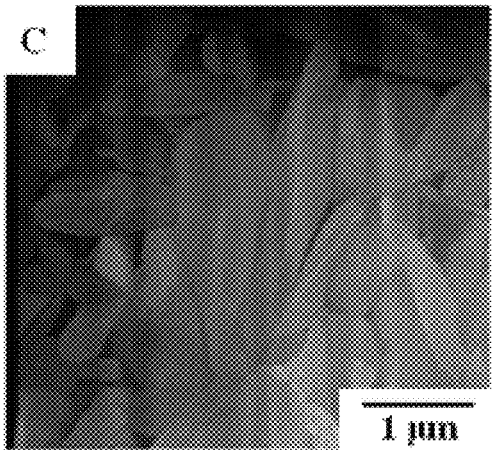
Figure 5D:
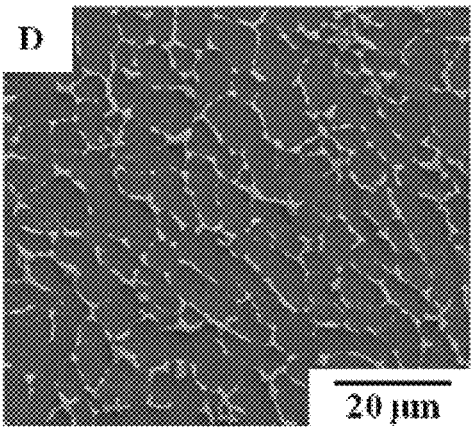

FIG. 5 shows SEM micrographs of the as-sintered microstructures of both vacuum sintered material (FIG. 5A) and material sintered in partial hydrogen (FIG. 5B). The SEM micrographs show that the microstructures produced by these two processes are drastically different. The specimen produced by vacuum sintering show typical coarse (α+β) lamellar microstructure (FIG. 5A: α in dark and β in bright contrast; β phase distributed at inter-granular α phases), which is the typical as-sintered microstructure of Ti-6Al-4V alloy by BE processes using Ti metal powder. In contrast, the specimen sintered in a partial pressure of hydrogen shows a clearly different microstructure. The microstructure produced by the hydrogen sintering process consists of ultrafine broken-up β phases (bright) in the matrix of refined α phases (dark contrast) as shown in FIG. 5B. The refined microstructure is further examined using a transmission electron microscope (TEM; FIG. 5C). Based on the SEM and TEM images, the mean grain size of β phases is about 0.5 μm and the mean grain size of α phase is about 1 μm.

Figure 5E:
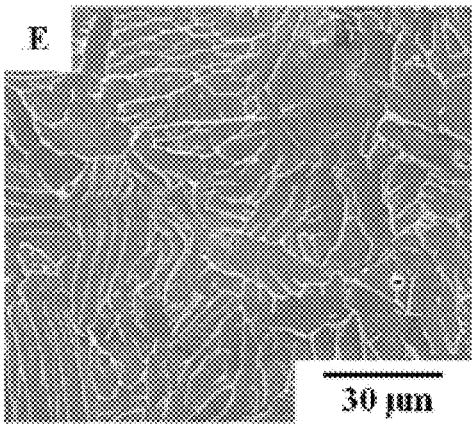

FIG. 5 also compares the microstructure of hydrogen sintered Ti to typically annealed, wrought Ti-6Al-4V (FIG. 5D), and typical vacuum sintered Ti metallic powder (FIG. 5E). The vacuum sintered $TiH_2$ powder is almost identical to that of vacuum sintered Ti metallic powder, albeit that the density of sintered $TiH_2$ is usually higher than that of sintered Ti under similar conditions. Compared to the wrought microstructure as shown in FIG. 5D, the hydrogen-sintered Ti microstructure is finer. It should be noted that the microstructure of wrought materials can vary significantly depending on exact thermo mechanical processing history.

Figure 4:
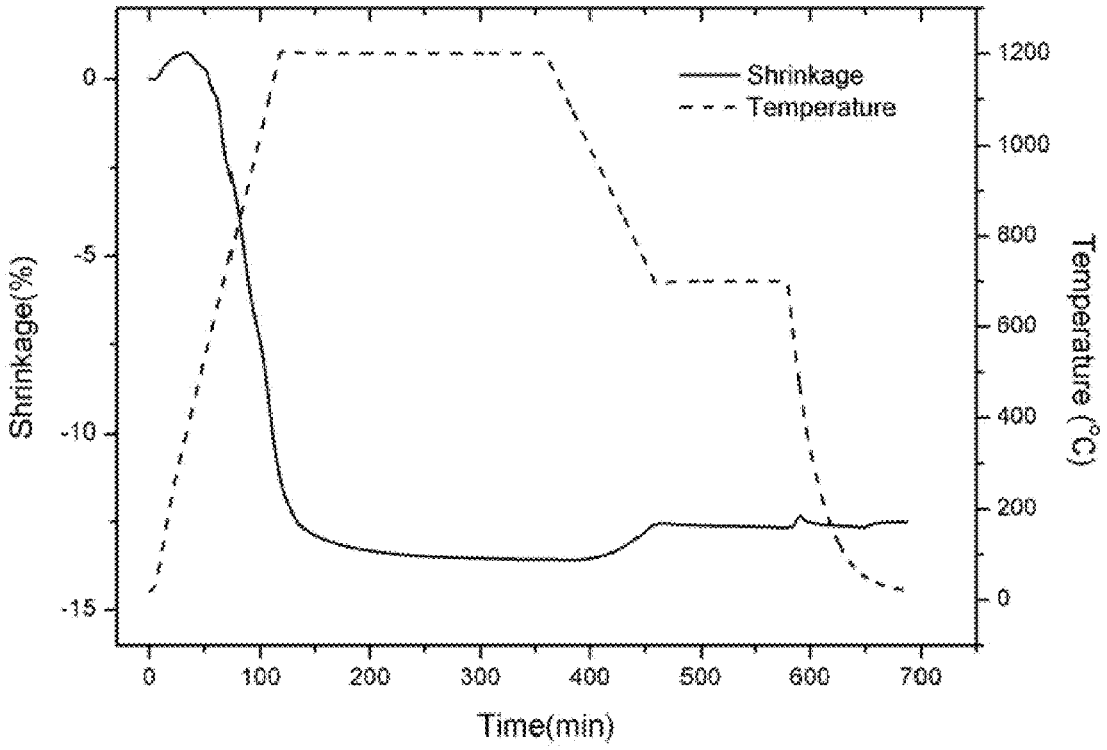
FIG. 4 illustrates a shrinkage curve of controlled hydrogen sintering of $TiH_2$—AlV, according to the examples.

Additionally, the titanium metal or titanium metal alloys obtained from the process can have a high relative density. In any of the above embodiments, the titanium metal or the titanium metal alloy can have a density greater than 95%. The titanium materials can be nearly fully dense (for example, greater than 99% relative density for CP—Ti and greater than 98% relative density for Ti-6Al-4V). Density measurements show specimens produced by both vacuum and atmospheric sintering have near full densification (~99% relative densities) after sintering, and the near full densification is also verified by scanning electron microscope (SEM) images that show very few pores. FIG. 4 shows the densification of a specimen after sintering in hydrogen prior to dehydrogenation. The volume expansion near the end of the curve is due to the increase of hydrogen content at lower temperatures.

The materials can also have lower oxygen content than equivalent titanium materials prepared using traditional powder metallurgy approaches, and can be substantially free of impurities. In some embodiments, the titanium metal or titanium metal alloy can have an oxygen content of less than 0.5 wt %. In other embodiments, the titanium metal or titanium metal alloy can have an oxygen content of less than 0.2 wt %. In other embodiments, the titanium metal or titanium metal alloy can have an oxygen content of from about 0.001 wt % to about 0.3 wt %.

In another aspect of the present technology, a material is provided that includes any of the titanium metal or titanium metal alloys produced by any of the above processes. The material can be a commercially pure titanium (CP—Ti). CP—Ti is a term that is widely used in the art. CP—Ti is classified on scale of Grade 1 to 4, each level of the scale being based upon the oxygen content and/or alloying according to industry standards. Alternatively the material can be a commercial alloy of Ti. In one embodiment, the material can be Ti-6Al-4V.

The materials prepared by the above processes can be achieved at lower cost because of the high yield of the processes, fewer processing steps, and lower energy consumption, compared to materials produced by traditional wrought alloy methods. The traditional wrought alloy methods refers to the manufacturing process by melting, casting, hot working, cold working and machining. The materials prepared by the presently described processes have fine grain sizes, and thus exhibit equivalent or superior mechanical properties to traditionally wrought alloys.

The titanium metal or titanium metal alloy materials above can find utility in any of a number of applications where titanium and its alloys are currently used, or will be used. For example, the materials can be used in, but not limited to, automobile parts, biomedical implants, medical surgical tools, aircraft equipment, diving equipment, oil field equipment, sports equipment, chemical equipment, food processing equipment, among others.

The microstructure produced by the above methods can have many advantages over the coarse lamellar structure of conventional sintered Ti materials, particularly with respect to mechanical properties. In comparison to wrought Ti materials and vacuum sintering of powder metallurgy Ti, the microstructure of materials produced and described above can lead to improved tensile and fatigue properties. Evaluations of basic tensile mechanical properties were carried out and are present in Table 1. Table 1 compares the tensile mechanical properties of the as-sintered, microstructured specimens produced by the present process (hydrogen-sintered) with ASTM standards as well as vacuum sintered Ti-6Al-4V.

TABLE I

Impurity Concentrations And Tensile Properties Of Vacuum-Sintered And Hydrogen-Sintered Ti—6Al—4V

| | Tensile strength (MPa) | 0.2% Yield strength (MPa) | Elongation (%) | O (wt %) | H (wt %) | C (wt %) | N (wt %) |
|---|---|---|---|---|---|---|---|
| ASTM B348 | 895 | 828 | 10 | 0.20 | 0.015 | 0.08 | 0.05 |
| Vacuum-sintered | 982 | 859 | 12 | 0.302 ± 0.044 | 0.004 ± 0.002 | 0.080 ± 0.012 | 0.025 ± 0.007 |
| Hydrogen-sintered | 1036 | 943 | 15 | 0.308 ± 0.07 | <0.003 | — | — |

From Table 1 it is observed that the tensile strength and ductility of the hydrogen-sintered material is slightly higher than that of the vacuum-sintered material. Without being bound by theory, it is believed that this difference is attributable to the finer grain size.

Table 1 also shows the chemical analysis of the as-sintered specimen. The oxygen content of these specimens is higher than that of ASTM standard for wrought material.

The oxygen content can be further reduced by controlling powder material handling procedures. The hydrogen content in the finished specimen is sufficiently low to meet ASTM standards. Carbon and nitrogen content of the material also meet the ASTM standards.

The results presented above demonstrate that Ti and Ti alloy powders can be sintered to near full density in partial hydrogen atmosphere at temperatures when β-Ti forms solid solution alloys with hydrogen. By controlling the eutectoid phase transformation from β to α+δ and the subsequent dehydrogenation process, near-fully dense Ti material with very fine microstructure can be obtained in as-sintered state without resorting to thermo mechanical working. This is a promising approach for producing PM Ti materials with superior mechanical properties at minimum cost.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

The present technology, thus generally described, will be understood more readily by reference to the following examples, which are provided by way of illustration and are not intended to be limiting.

EXAMPLES

Example 1

Figure 3:
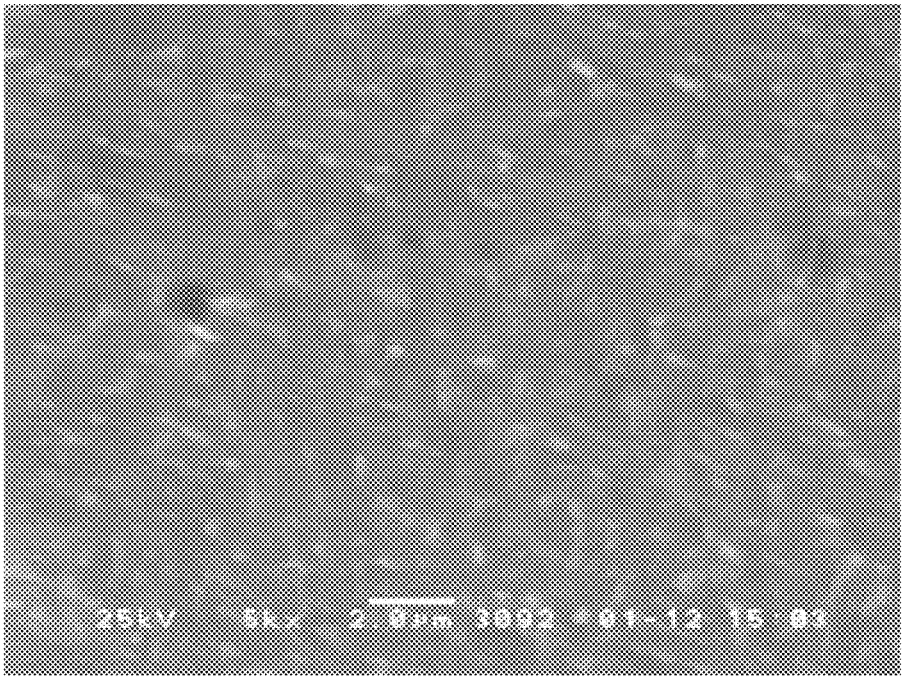
FIG. 3 is an SEM micrograph illustrating the ultrafine microstructure of a Ti-6Al-4V alloy produced according to the examples.

Commercial $TiH_2$ powder (46.8750 g) and 60Al-40V alloy powder (5.0000 g) were blended using a tumbler mixer. The particle size of both the $TiH_2$ and the 60Al-40V alloy powders were −325 mesh. The specific surface area (BET) of the −325 mesh $TiH_2$ was 0.197 $m^2/g$. The blended powders were cold isostatically pressed at 350 MPa (megapascal) to prepare a cylindrical sample about 15 mm in diameter and about 70 min in length. The sample was then heated in an alumina tube furnace (76 mm in diameter by 1200 mm long) up to 1200° C. at 10° C./min. The sample was held that temperature for 4 hours under a specific atmosphere. The sample was then cooled to 650° C. at a rate of 5° C. per minute and held at this temperature for 4 hours. The sample was then cooled to room temperature in the furnace. A molybdenum crucible was used as the sample holder during sintering process. The entire sintering process was conducted in a stream of high purity argon (purity>99.999%, $O_2$%<1 ppm, $H_2O$<1 ppm) and hydrogen (purity>99.999%, $O_2$%<1 ppm, $H_2O$<2 ppm) with a slightly positive pressure. The flow rates of the argon and hydrogen were 1.8 L/min and 320 mL/min, respectively. The sample was then re-heated in the alumina tube under vacuum condition ($10^{-4}$ Pa) to 700° C. at a heating rate of 10° C./min and held at this temperature for 8 hours for dehydrogenation. A schematic of the heating profile is illustrated in FIG. 2. FIG. 3 is a photograph of the fine grain material produced. In FIG. 3, the mean grain size of the β phases is about 0.5 μm (bright spots), and the mean grain size of a phases is about 1-4 μm (dark color) in the as-dehydrogenated article. The relative density of the material was 98.5%, and oxygen content was 0.210 wt %.

Example 2

Commercial $TiH_2$ powder (~97.9945 g) and 60Al-40V alloy powder (10.4527 g) were blended and milled using an attritor mill (Union Process, model#01HD). The particle size of the $TiH_2$ and the 60Al-40V alloy powders were −20+60 mesh and −325 mesh, respectively. The attritor mill was loaded with 200 mL mineral oil (flash point 135° C.) and 1436 g stainless steel balls with a diameter of 6.4 mm. The mill was equipped with a water cooled jacket through which cooling water passed during milling. The entire milling process was conducted in a stream of industrial pure argon (purity >99.998%, $O_2$%<4 ppm, $H_2O$<3 ppm) with a flow rate of 1 L/min and a slightly positive pressure. The attritor was purged with argon for 15 min to remove air before the start of milling and 30 min to cool the powder to room temperature after milling. Milling was carried out for 27 min. The value of the BET measurement increased from a value beneath the instrument's capacity to measure for the starting powder to 0.793 $m^2/g$ for the milled powder. After milling, vacuum filtration was used to remove most of the mineral oil, and then the powder was die-pressed at 380 MPa to make a green part (diameter 16 mm, thickness 10 mm), during which some of the remaining mineral oil was squeezed out from the die. The remainder of the mineral oil remaining in the powder was completely removed by a thermal de-oil process, in which it was held at 200° C. for 3 hours, 250° C. for 3 hours and 350° C. for 2 hours. After the thermal de-oil process, the sample was heated directly to 1200° C. at 10° C./min for sintering without cooling. The sample was then cooled to 650° C. at a rate of 5° C. per minute after holding at 1200° C. for 4 hours, and then held at 650° C. for another 4 hours. The de-oil and sintering process were conducted in a flowing mixed gas of high purity argon and hydrogen with a slightly positive pressure. The flow rate of both argon and hydrogen was 1.0 L/min. The hydrogen flow was shut off at the end of holing at 650° C., and the sample was furnace-cooled to room temperature in flowing pure Ar. In the last step, it was re-heated under vacuum condition ($10^{-4}$ Pa) to 750° C. at a heating rate of 10° C. min and held at this temperature for 12 hours for dehydrogenation. The density of as-sintered Ti-6Al-4V was 99.5%. Oxygen content in the material was 0.205 wt %.

Example 3

Production of CP—Ti and Ti-6Al-4V alloy tensile bars. $TiH_2$ and Al—V master alloy powders were supplied by Reading Alloys. $TiH_2$ was directly used to produce CP—Ti. $TiH_2$ and alloy powder were mixed according to appropriate compositions for Ti-6Al-4V alloy. Cylindrical powder compacts were made in a cold iso-static press (CIP) using 350 MPa pressure. Dimensions of the green compacts were a diameter of approximately 15 mm and a length of 60 mm. The compacts were then subjected to sintering in a partial hydrogen atmosphere. The sintering condition for CP—Ti and Ti-6Al-4V were the same, holding at 1200° C. for 4 hours. After that, in the case of making CP—Ti, samples were cooled to 550° C. and held for 2 hours in flowing 10% high purity $H_2$ balanced with Ar, and then held at 250° C. for another 2 hours in flowing 100% Ar; in the case of producing Ti-6Al-4V, samples were cooled to 650° C. and held for 4 hours in 50% $H_2$, and then furnace-cooled to room temperature in flowing 100% Ar. In the last step, both CP—Ti and Ti-6Al-4V were re-heated under vacuum conditions ($10^{-4}$ Pa) to 750° C. at a heating rate of 10° C./min and held at this temperature for 12 hours for dehydrogenation. Sintered samples were machined to standard tensile rods with gauge diameter of 6.4 mm and length of 25.6 mm. The relative density of CP—Ti and Ti-6Al-4V was 99.5% and 98.5%, respectively. Tensile properties of CP—Ti were an ultimate tensile strength (UTS)—686 MPa, 0.2% yield strength (YS)—569 MPa, elongation (El)—28% and reduction area (RA)—36%; tensile properties of Ti-6Al-4V were UTS—959 MPa, 0.2% YS—883 MPa, El—15% and RA—23%.

What is claimed is:

1. A process for producing a sintered titanium material with fine grain size comprising:

sintering a particulate titanium feed material in a dynamically controlled hydrogen atmosphere at an elevated temperature to form a sintered titanium material containing hydrogen, wherein the particulate titanium feed material includes at least one of titanium metal (Ti) and hydrogenated titanium or Ti hydride ($TiH_2$), wherein the dynamically controlled hydrogen atmosphere comprises primarily hydrogen that was not produced from the particulate titanium feed material, and wherein the sintered titanium material has a density greater than 95%; and heating the sintered titanium material under vacuum or controlled inert atmosphere at a temperature which is less than the sintering temperature sufficient to remove hydrogen from the sintered titanium material.

2. The process of claim 1, further comprising equilibrating the sintered material at an equilibration temperature below the sintering temperature and above the temperature of phase transformations including eutectoid decomposition for an equilibration time sufficient for the hydrogen within the sample to reach equilibrium with the dynamically controlled hydrogen atmosphere and homogenize the sintered titanium material.

3. The process of claim 1, further comprising holding the sintered titanium material at a hold temperature below the said elevated temperature of sintering and a hold time sufficient for phase transformations including eutectoid decomposition of the sintered titanium material.

4. The process of claim 3, wherein the holding is performed in the dynamically controlled hydrogen atmosphere.

5. The process of claim 3, wherein the phase transformations hold temperature is from about 400° C. to about 800° C.

6. The process of claim 3, wherein the phase transformations hold temperature is from about 150° C. to about 400° C.

7. The process of claim 3, wherein the phase transformations hold time is from about 10 minutes to about 120 hours.

8. The process of claim 1, wherein the sintering further comprises sintering the particulate titanium feed material in the presence of an alloying additive.

9. The process of claim 1, wherein the dynamically controlled hydrogen atmosphere includes a mixture of the hydrogen and an inert gas.

10. The process of claim 1, wherein the dynamically controlled hydrogen atmosphere consists essentially of hydrogen at a controlled absolute pressure.

11. The process of claim 1, wherein the sintered titanium material has a microstructure comprising α-phase, α2-phase, δ-phase and β phase.

12. The process of claim 1, wherein the elevated temperature is from about 1000° C. to about 1500° C.

13. The process of claim 1, wherein the dynamically controlled hydrogen atmosphere includes a partial pressure of hydrogen, and the partial pressure of hydrogen and the elevated temperature are sufficient to form a solid solution of β-phase titanium with hydrogen.

14. The process of claim 13, wherein the partial pressure of hydrogen is greater than 0.01 atm.

15. The process of claim 1, wherein the sintering is conducted from about 5 minutes to about 30 hours.

16. The process of claim 1, wherein heating the sintered titanium material under vacuum or controlled inert atmosphere is conducted from about 400° C. to about 900° C.

17. The process of claim 1, wherein heating the sintered titanium material under vacuum or controlled inert atmosphere is conducted from about 1 hour to about 200 hours.

18. The process of claim 1, wherein the sintered titanium material has a final grain size of from about 10 nm to about 10 μm.

19. The process of claim 1, wherein the sintered titanium material has a final grain size of from about 10 μm to about 100 μm.

20. The process of claim 1, wherein the dynamically controlled hydrogen atmosphere has a hydrogen to inert gas ratio from about 1:100 to about 1:0.

21. The process of claim 1, wherein the dynamically controlled hydrogen atmosphere has an absolute pressure of 0.01 atm to 10 atm.

22. The process of claim 1, wherein the dynamically controlled hydrogen atmosphere includes a hydrogen partial pressure which is varied during the process in order to achieve a target hydrogen concentration within the sintered titanium material as a function of time.

23. The process of claim 1, further comprising cooling the sintered titanium material at a non-uniform rate, wherein the cooling is at least one of cooling from the elevated temperature to the equilibration temperature and cooling from the equilibration temperature to the phase transformations including eutectoid decomposition temperature.

24. The process of claim 1, wherein the sintered titanium material has a density of greater than 99%.

25. The process of claim 1, wherein the as-sintered titanium material has an average grain size less than 20 micrometer.

26. The process of claim 1, wherein the as-sintered titanium material has an average grain size less than 5 micrometer.

27. The process of claim 1, wherein the sintered titanium material has an oxygen content of from about 0.001 wt % to about 0.5 wt %.

28. The process of claim 1, wherein the particulate titanium feed material comprises a powder having an initial size from about 20 mesh to about 1200 mesh.

29. The process of claim 1, wherein the particulate titanium feed material comprises a powder having an average initial size from about 325 to about 400 mesh.

30. The process of claim 1, wherein the particulate titanium feed material comprises a powder having an initial size from about 400 to about 1200 mesh.

31. The process of claim 1, wherein the particulate titanium feed material is prepared by combining source powders having average particle sizes greater than 20 μm with a non-volatile liquid to produce a mixture, and subjecting the mixture to a particle size reduction process such that the particulate titanium feed material has average particle sizes less than 20 μm.

32. The process claim 1, which is void of post-sintering mechanical processing steps.

33. The process of claim 1, wherein the sintered titanium material has a density of greater than 97%.

* * * * *